US006595746B1

(12) United States Patent
Goto et al.

(10) Patent No.: US 6,595,746 B1
(45) Date of Patent: Jul. 22, 2003

(54) MIXED FLOW PUMP

(75) Inventors: Akira Goto, Kanagawa (JP); Kosuke Ashihara, Kanagawa (JP); Takaki Sakurai, Tokyo (JP); Masatoshi Suzuki, Tokyo (JP); Mehrdad Zangeneh, London (GB)

(73) Assignees: Ebara Corporation, Tokyo (JP); University College London, London (GB)

( * ) Notice: Subject to any disclaimer, the term of this patent is extended or adjusted under 35 U.S.C. 154(b) by 0 days.

(21) Appl. No.: 09/647,531

(22) PCT Filed: Apr. 24, 1998

(86) PCT No.: PCT/GB98/01215

§ 371 (c)(1),
(2), (4) Date: Jan. 30, 2001

(87) PCT Pub. No.: WO99/56022

PCT Pub. Date: Nov. 4, 1999

(51) Int. Cl.[7] ..... F04D 29/44
(52) U.S. Cl. ..... 415/208.2; 415/211.2
(58) Field of Search ..... 415/199.1, 208.2, 415/211.2

(56) References Cited

U.S. PATENT DOCUMENTS

| | | | | | |
|---|---|---|---|---|---|
| 1,502,865 | A | * | 7/1924 | Moody | 415/208.2 |
| 1,554,591 | A | * | 9/1925 | Oliver | 415/194 |
| 2,855,141 | A | * | 10/1958 | Van Rijn | 415/208.2 |
| 3,438,329 | A | * | 4/1969 | Fuller | 415/199.3 |
| 3,986,791 | A | * | 10/1976 | Paciga et al. | 415/199.2 |
| 4,063,849 | A | * | 12/1977 | Modianos | 415/182.1 |
| 4,865,519 | A | | 9/1989 | Diankui et al. | |

FOREIGN PATENT DOCUMENTS

| | | |
|---|---|---|
| FR | 2 665 224 | 1/1992 |
| GB | 604121 | 9/1948 |
| GB | 1016097 | 1/1966 |

OTHER PUBLICATIONS

John L. Dicmas, "Verticle Turbine, Mixed Flow, and Propeller Pumps", McGraw–Hill Book Company, pp. 314–321, 1987.

* cited by examiner

*Primary Examiner*—Edward K. Look
*Assistant Examiner*—Igor Kershteyn
(74) *Attorney, Agent, or Firm*—Wenderoth, Lind & Ponack, L.L.P.

(57) ABSTRACT

A highly efficient mixed flow pump can prevent flow separation which is likely to occur in a corner portion of a flow passage of a diffuser section. The mixed flow pump includes a casing having an axis and defining an impeller section and a diffuser section disposed downstream of the impeller section with stationary diffuser blades protruding from a hub. The diffuser blades are formed so that an angular difference, between a hub blade angle and a casing blade angle, is chosen to conform to a specific distribution pattern along a flow passage of the diffuser section.

10 Claims, 19 Drawing Sheets

$$\theta_h^* = \theta_h + m \cdot \Delta\theta_{TE}$$

$$\tan\beta_h^* = dm / d(r\theta_h^*)$$

$$\Delta\beta^* = \beta_h^* - \beta_c$$

MIXED FLOW PUMP

BACKGROUND OF THE INVENTION

1. Field of the Invention

The present invention relates, in general, to a mixed flow pump having a diffuser section with diffuser blades for guiding flow therein.

2. Description of the Related Art

A conventional mixed flow pump, shown in a cross sectional view in FIG. 12, is comprised of a casing 16 housing an impeller 12 rotating about an axis of a rotation shaft 10, and a stationary diffuser section 14 disposed downstream of the impeller 12. The flow passage P in the diffuser section 14 is formed as a three-dimensionally curved space in a ring-shaped space formed between the casing 16 and a hub 18, separated by diffuser blades 20. A fluid medium taken through a pump inlet 22 is given kinetic energy by the rotating impeller 12, and is reduced of its circumferential velocity as the fluid enters into the stationary diffuser section 14, and the kinetic energy at the impeller exit is recovered as a static pressure in the pumping system.

The shape of the flow passage P in the diffuser section 14 is defined according to the shape of the meridional (axisymmetrical) surfaces of the hub 18 and the casing 16 and the geometrical shape of the diffuser blades 20. Of these three, the shape of the blades is determined by choosing a distribution pattern of blade angle β which is an angle between a direction M tangential to a center line of the blade on the axisymmetrical surface of the hub 18 or the casing 16 at any given point along the blade length and the tangent L in the circumferential direction at that point, as illustrated in FIG. 13A.

The blade angle β is given by an equation relating the meridional distance m (defined by the distance along the line of intersection of a plane containing the rotation axis of the impeller 12 and the axisymmetrical surface) and a circumferential coordinate θ and a radial coordinate r for the blade center line as follows (refer to FIG. 13C):

$$\tan \beta = dm/d(r\theta) \quad (1)$$

The blade angle β of the diffuser blade 20 at the entrance-side of the diffuser section 14 is chosen to coincide with the direction of the stream flow at the exit of the impeller 12, and the blade angle β of the diffuser blade 20 at the exit-side of the diffuser section 14 is chosen so that the exiting flow is produced primarily in the axial direction after being eliminated of the circumferential velocity component of the flow. In the flow passage that lies between the entry and exit regions of the diffuser section 14, it is a general practice in the conventional design technology to adopt a smooth transition of blade angles resulting in that, as shown in FIG. 14A, the blade angle distribution pattern is similar along the hub surface and along the casing surface. In the illustration shown in FIG. 14A, the non-dimensional distance m* is defined by normalizing the meridional distance m by the distance l from the leading edge to the trailing edge of a blade along either the hub surface or, the casing surface. FIG. 15 shows the blade angle distribution pattern of the blade angle difference Δβ between the hub blade angle and the casing blade angle in a conventional diffuser section operating in a specific speed range between 280~700 (m, $m^3$/min, rpm) with respect to the non-dimensional distance m*. It can be seen that, in either case, the absolute value of the blade angle difference |Δβ| in the distribution pattern is less than 10 degrees, indicating that the blade angle distribution patterns at the hub surface and at the casing surface of a blade are substantially similar along any blade.

However, actual flow fields in the diffuser section in an operating pump are composed of complex three-dimensional flow patterns, and the frictional effects along the walls on the flow passage produce low-energy fluids which tend to accumulate at the corner regions of the suction surface and the hub surface due to the secondary flows action. In the conventional designs, a smooth merging of flow passage is produced by choosing the blade angle distribution as described above. However, because the three-dimensional flow fields are not taken into consideration, it has been difficult to prevent a large-scale flow separation from being generated at the corner or blade root regions where the hub surface meets with the suction surface of the blade.

FIG. 16 is a schematic plan view of secondary flows generated on the suction surface of the blade, while FIG. 17 is a schematic plan view of the secondary flow patterns generated on the hub surface in the conventional technology. The low-energy fluids accumulated at the blade root regions of the diffuser section do not have sufficient kinetic energy to overcome the pressure rise in the diffuser section, and as a result, flow separation and reverse flow occur in these blade root regions as illustrated in FIG. 17.

In the following, the problems encountered in the conventional diffuser section designs will be explained in further detail with reference to a three-dimensional viscous flow analysis. FIG. 18A shows contour lines of the static pressure distribution diagram on the suction surface of the blade, and FIG. 18B shows the contour lines of the total pressure distribution diagram in the flow passage section at a non-dimensional distance m*=0.59, and FIGS. 19A and 19B show the predicted velocity vectors close to the suction surface and the hub surface.

As shown in FIG. 18A, in the conventional diffuser section, the contour lines in the entry section of the suction surface (region A) are roughly parallel to the flow passage P. The flow streams having lost their kinetic-energy through the frictional effects along the blade wall are not able to resist the adverse pressure gradient, and generates secondary flows along the contour lines in the static pressure distribution diagram, as shown in FIG. 19A.

Because the flow velocity is high in the diffuser entry section, especially near the suction surface, a large friction loss is generated on the blade walls, and the low-energy fluids are drawn by the secondary flows on the suction surface and accumulate in the corner regions (region B) formed between the downstream hub section and the suction surface.

As can be understood from the dense distribution of the contour lines shown in FIG. 18A, the adverse pressure gradient is high at the corner region B, thus generating a large-scale flow separation as illustrated in FIGS. 19A and B, thereby causing a significant loss in the pumping efficiency. This situation becomes more acute, especially when the pump is made compact, because the loading on the blade increases and leads to an increase in the adverse pressure gradient, so the pump becomes even more sensitive to the separation phenomenon. These are some of the basic reasons that have prevented the conventional technology from making compact and high efficiency pumps.

SUMMARY OF THE INVENTION

It is an object of the present invention to provide a highly efficient mixed flow pump by optimizing secondary flows in the diffuser section so as to prevent flow separation which is likely to occur in the corner region of the flow passage of the diffuser section.

The object has been achieved in a mixed flow pump comprising a casing having an axis and defining an impeller section and a diffuser section disposed downstream of the impeller section. The impeller section comprises an impeller rotating about the axis. The diffuser section has a hub and stationary diffuser blades, wherein the diffuser blades are formed so that an angular difference, between a hub blade angle and a casing blade angle, is chosen to conform to a specific distribution pattern along a flow passage of the diffuser section. Accordingly, by choosing an appropriate design of the blade angle of the diffuser blades, a suitable pressure distribution pattern along the flow passage in the diffuser section is obtained by optimizing secondary flows.

In the mixed flow pump presented, the blade angle may be defined in terms of an angle between a circumferential tangent line at a point on the blade surface at a level of hub surface or casing surface and a tangent line of a center line of a cross section of the blade along the hub surface or casing surface, and the specific distribution pattern is such that a hub blade angle is greater than a casing blade angle in a wide range of the flow passage. Accordingly, the pressure rise along the hub surface is completed before the pressure rise along the casing surface so that the flow speed reduction along the hub surface is completed before the flow speed reduction on the casing side, thereby enabling the static pressure recovery on the hub side to supercede the recovery on the casing side of the pump.

DESCRIPTION OF THE PREFERRED EMBODIMENTS

Figure 1:
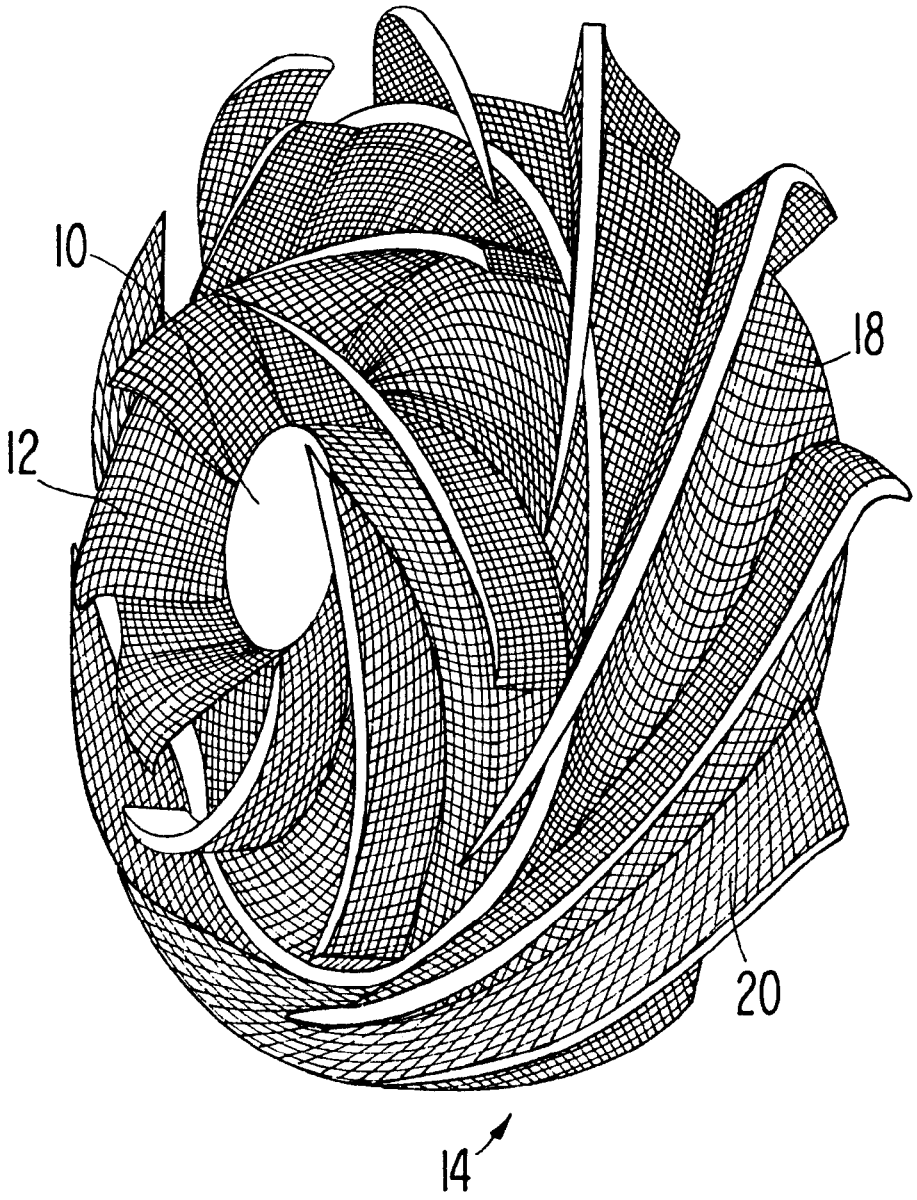
FIG. 1 is a perspective drawing of essential parts of an embodiment of a mixed flow pump of the present invention.
Figure 2:
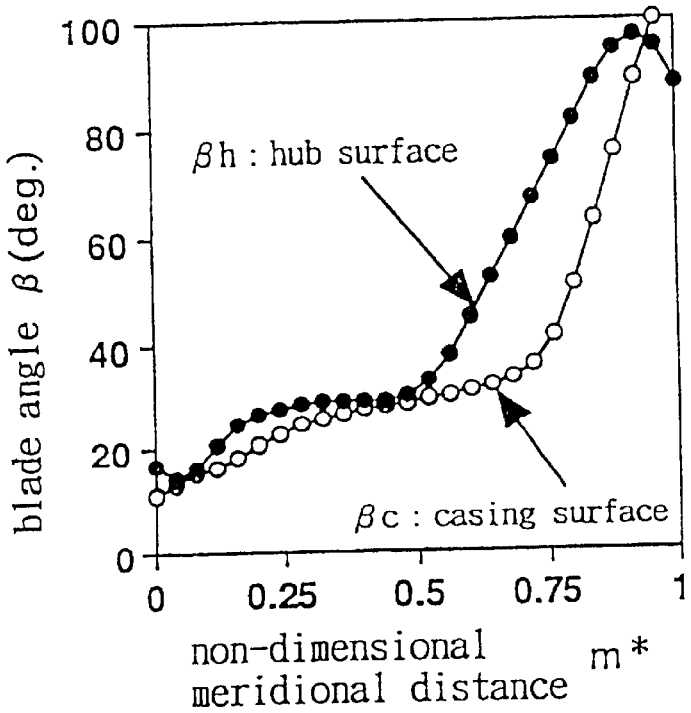
FIG. 2 is a graph showing a blade angle distribution pattern in a diffuser section of the pump of the present invention.
Figure 13A:
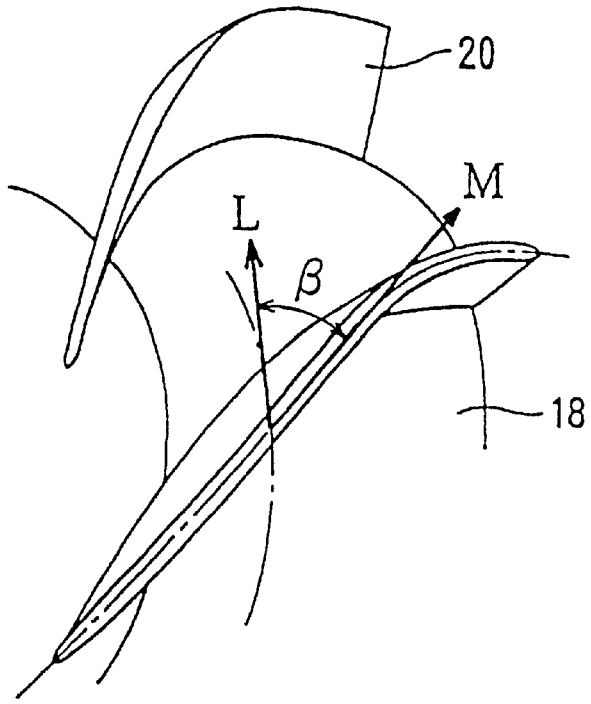
FIG. 13A is a drawing to illustrate the definition of the blade angle $\beta$ on a casing surface of the diffuser blade.
Figure 13B:
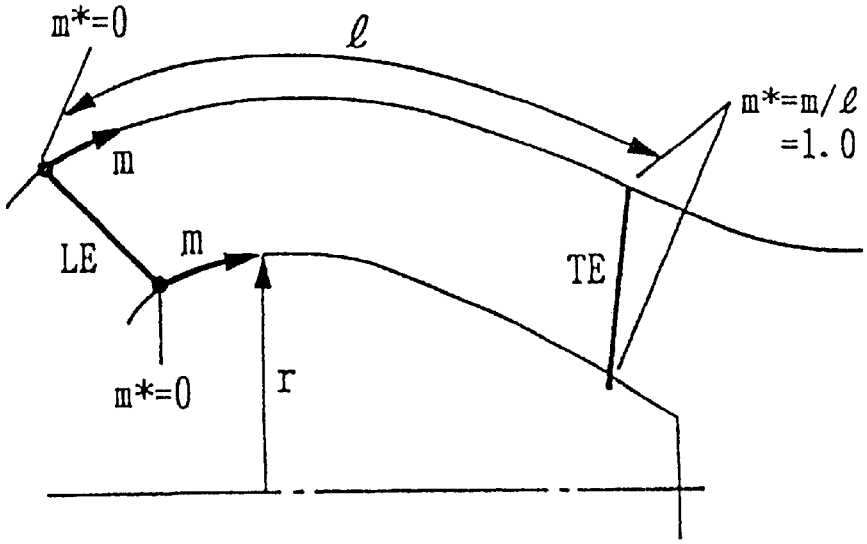
FIG. 13B is a drawing to illustrate definition of the coordination on a meridional surface of the diffuser blade.
Figure 13C:
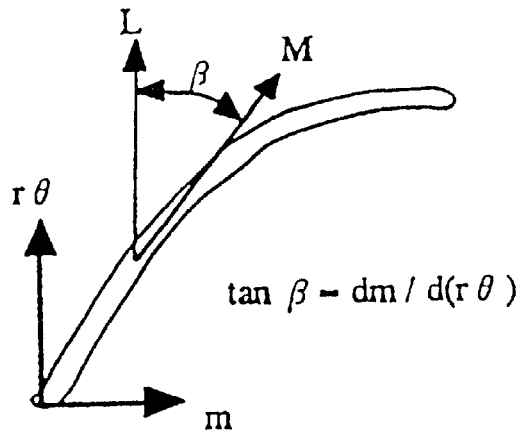
FIG. 13C is a drawing to illustrate the coordination and the blade angle $\beta$ on an axisymmetrical surface of the diffuser blade section.

FIG. 1 shows essential components of a mixed flow pump of an embodiment according to the present invention. The essential feature of the invention resides in a configuration of diffuser blades 20 in a diffuser section 14. The blade angles of the blades 20 of the pump are distributed along the meridional surfaces as shown in FIG. 2 in which the horizontal axis relates to the non-dimensional distances along the flow passage, and the vertical axis relates to the blade angle $\beta$ as defined in FIG. 13A. As can be understood from this, the blade angle $\beta_h$ of the blade 20 on the hub surface increases gently to a vicinity of a point given by a non-dimensional distance $m^*=0.5$, but thereafter it increases rather sharply. On the other hand, the blade angle $\beta_c$ on the casing surface increases gently at about the same rate as $\beta_h$ to a non-dimensional distance m*=0.4 and continues to increase at about a similar rate to a non-dimensional distance m*=0.75, and thereafter increases quite sharply.

Figure 3:
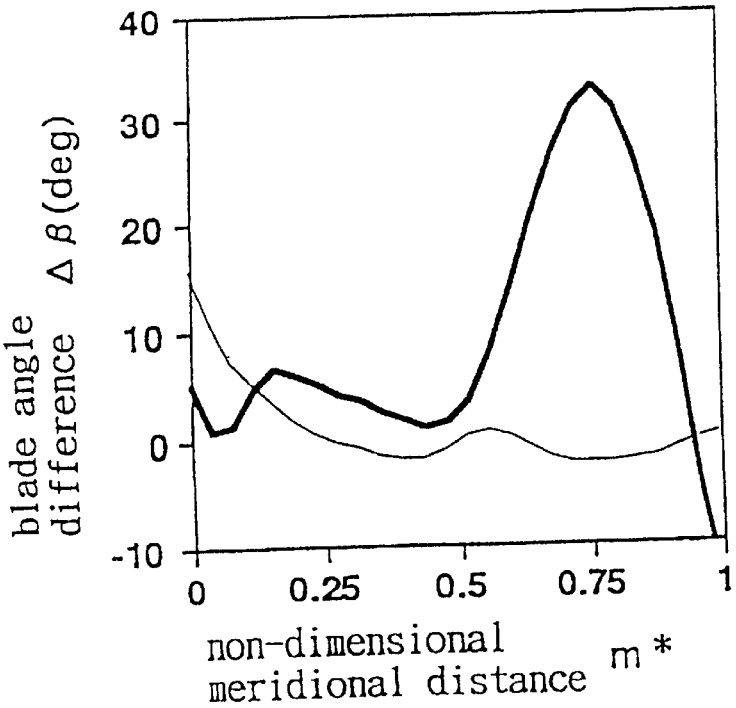
FIG. 3 is a graph showing a comparison of the differences in the blade angles along a flow passage in the pump according to an embodiment of the present invention and the conventional pump.
Figure 15:
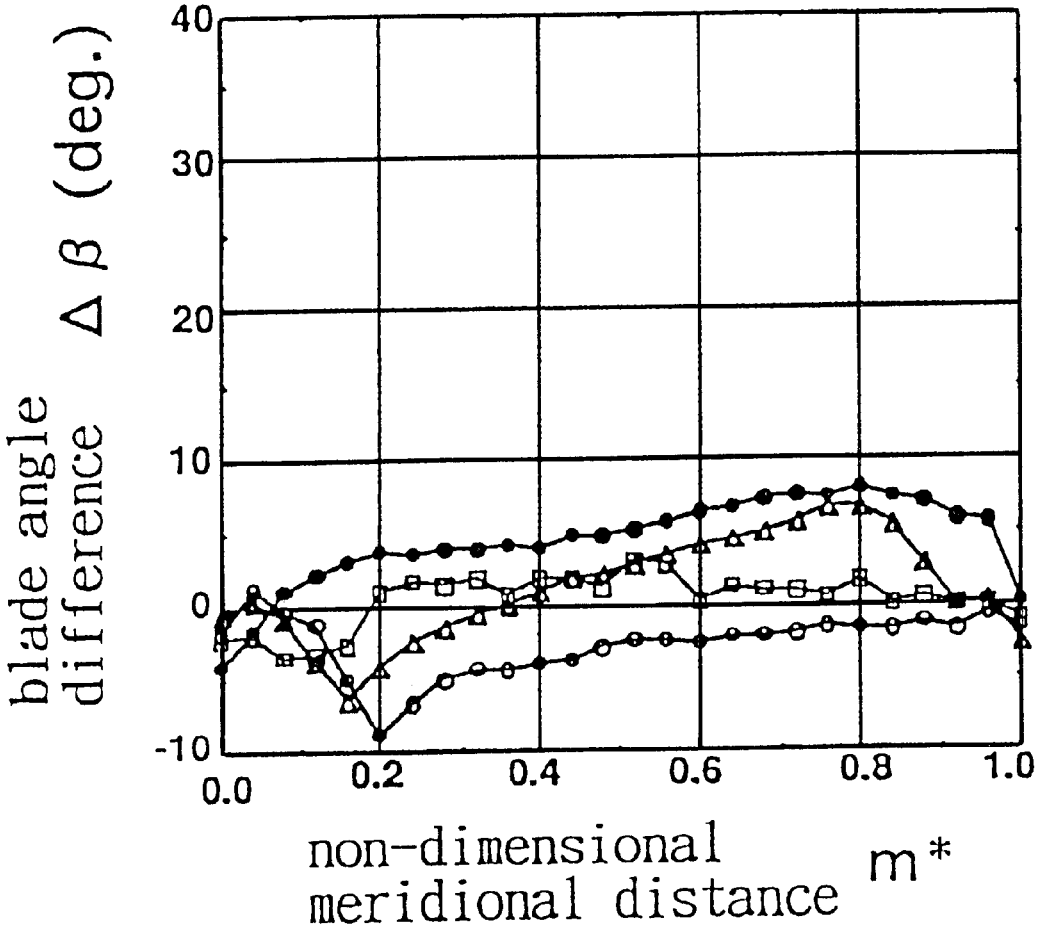
FIG. 15 is a graph showing the blade angle difference $\Delta\beta$ as a function of the non-meridional distance $m^*$ in the conventional mixed flow pump.
Figure 16:
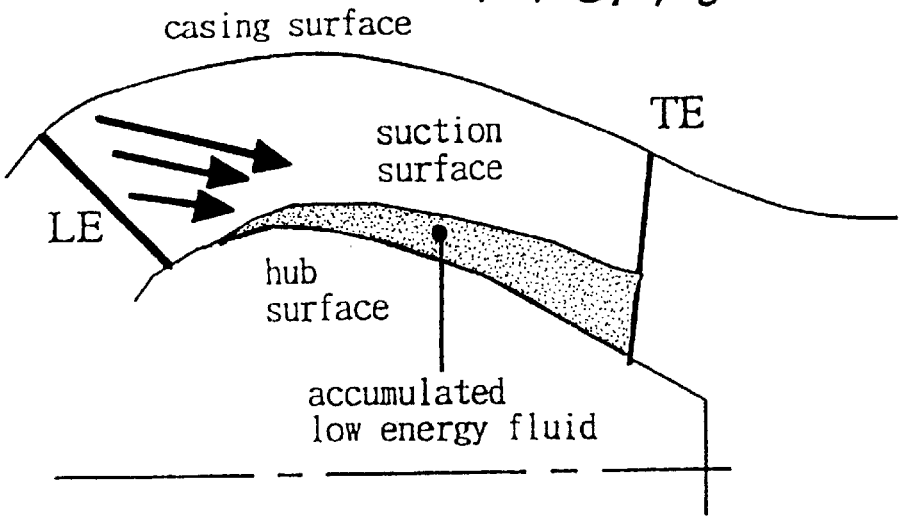
FIGS. 16 is an illustration of the secondary flow patterns on the suction surfaces of the diffuser blade in the conventional mixed flow pump.
Figure 17:
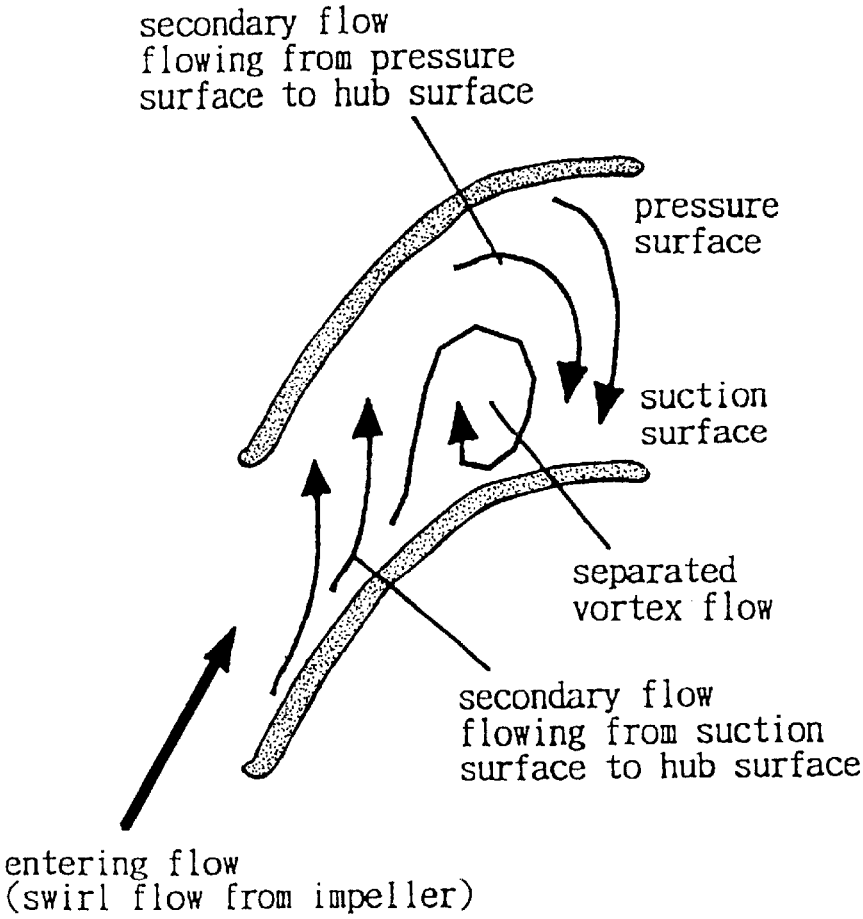
FIG. 17 is a plan view of the secondary flow patterns on the hub surface of the diffuser section in the conventional mixed flow pump.
Figure 18A:
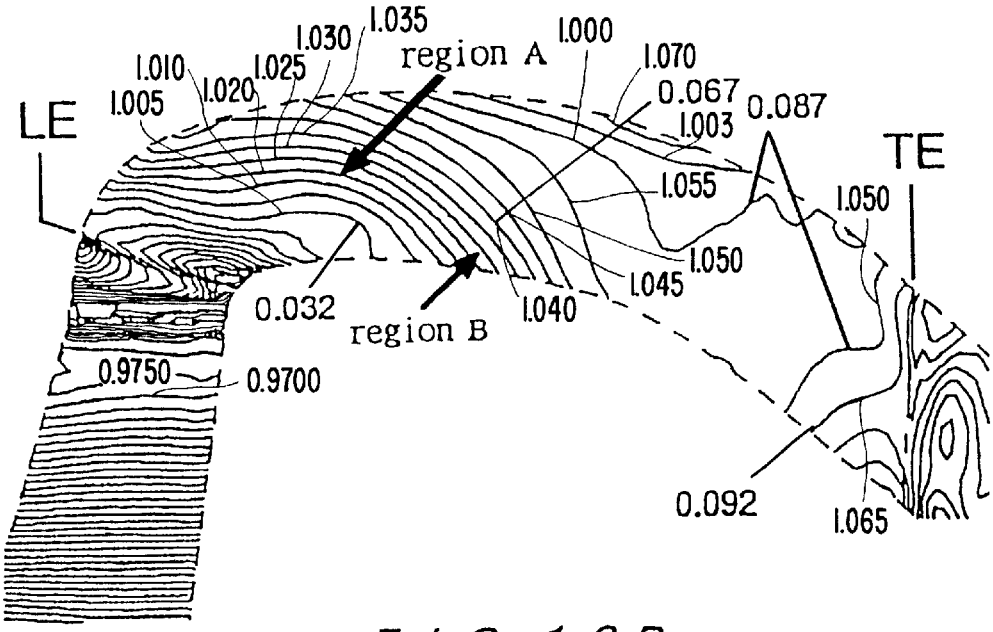
FIG. 18A shows the contour lines of the pressure distribution on the suction surface of the blade in the flow passage in the diffuser section in the conventional mixed flow pump.
Figure 18B:
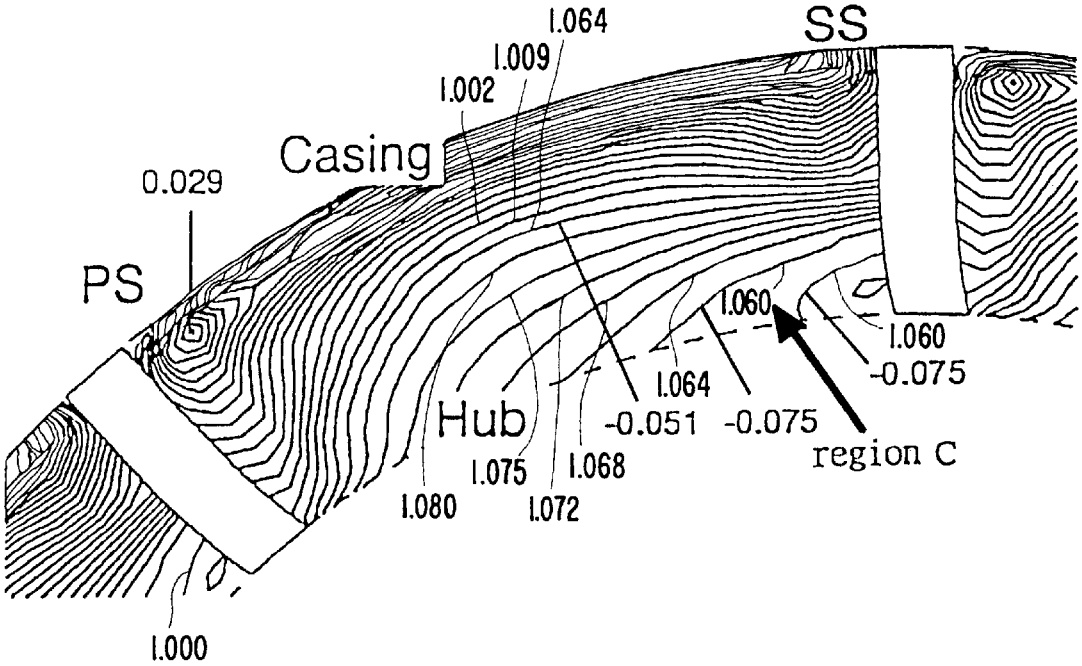
FIG. 18B shows the contour lines of the total pressure distribution diagram in a circumferential cross section of the flow passage section at a non-dimensional distance $m^*=0.59$ in the diffuser section in the conventional mixed flow pump.

The result is that, as shown in a comparative diagram in FIG. 3, the blade angle difference $\Delta\beta$ between the hub blade angle $\beta_h$ and the casing blade angle $\beta_c$ is about the same in the front half of the diffuser flow passage P, but in the rear half of the diffuser flow passage P, the hub blade angle $\beta_h$ is larger than the casing blade angle $\beta_c$. In this example, the blade angle difference $\Delta\beta$ increases rapidly from a point at m*=0.5, and the difference reaches a peak value of about 30 degrees at m*=0.75. It can be recognized that this angular distribution pattern is significantly different from the conventional distribution pattern shown in FIG. 15.

Figure 4A:
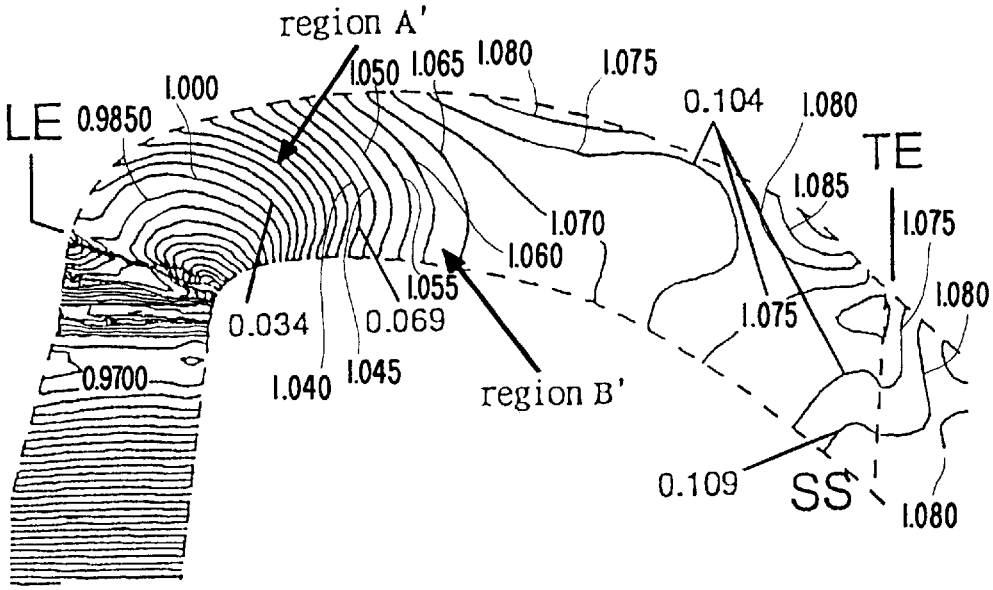
FIG. 4A shows contour lines of pressure distribution on a suction surface of the blade in the flow passage in the diffuser section in the pump according to an embodiment of the present invention.
Figure 4B:
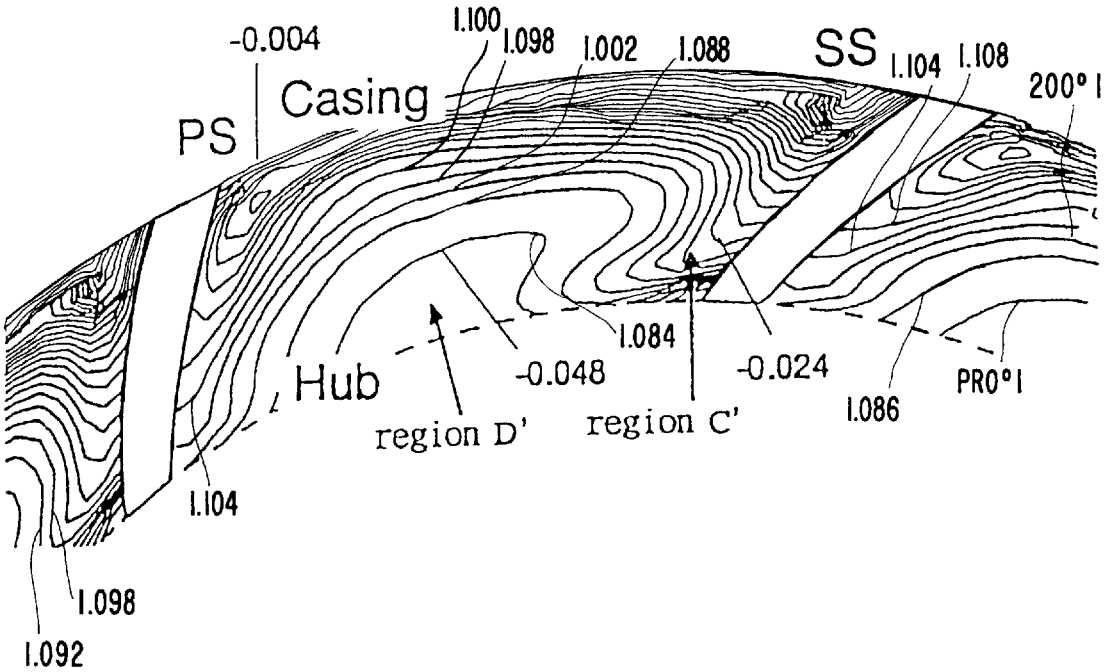
FIG. 4B shows contour lines of a total pressure distribution diagram in a circumferential cross section of the flow passage section at a non-dimensional distance $m^*=0.59$ in the diffuser section in the pump according to an embodiment of the present invention.
Figure 5A:
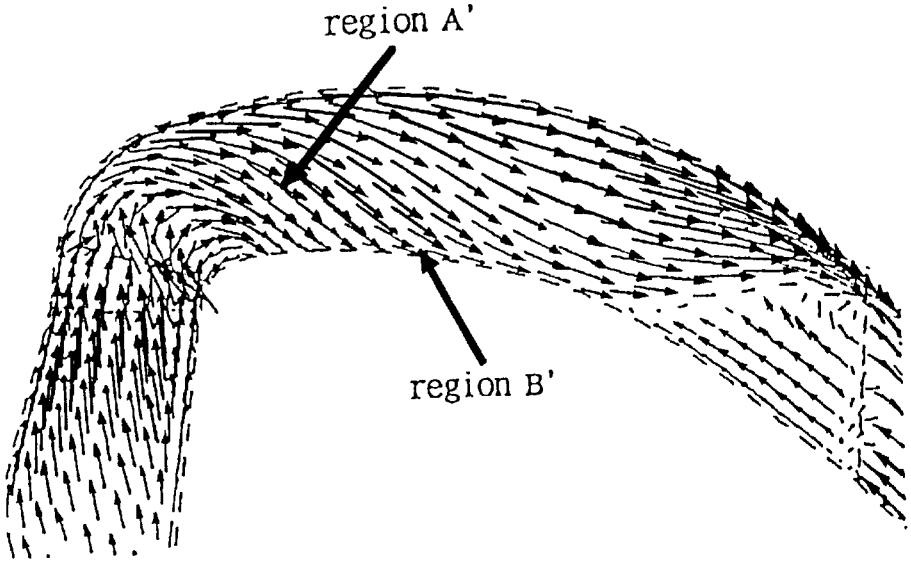
FIGS. 5A and 5B are velocity vectors of flow fields in the diffuser section in the pump according to an embodiment of the present invention.

FIGS. 4A, 4B and 5A, 5B show predicted pressure distribution patterns and velocity vectors in the flow passage P in the diffuser section 14 of the present mixed flow pump, computed by using a three-dimensional viscous flow analysis. The contour lines of the static pressures in the entry section (region A') shown in FIG. 4A are formed about perpendicular to the passage P, and the secondary flows flowing along the contour lines flow towards the hub surface as shown in FIG. 5A. Therefore, due to the changes in the secondary flow pattern, the high-loss fluid which would have been accumulated in the corner region of the diffuser section in the conventionally designed diffuser is passed over the corner region and is accumulated in a region D' on the hub side in the mid-pitch location of the flow passage. The high-energy fluid flowing in the casing-side flows into the corner region (region C', refer to FIG. 4B), and because the adverse pressure gradient in this region is small (region B', refer to FIG. 4A), the flow separation generated on the, hub surface is shrunk, as can be confirmed in FIG. 5B, thereby improving the flow fields significantly.

Figure 6A:
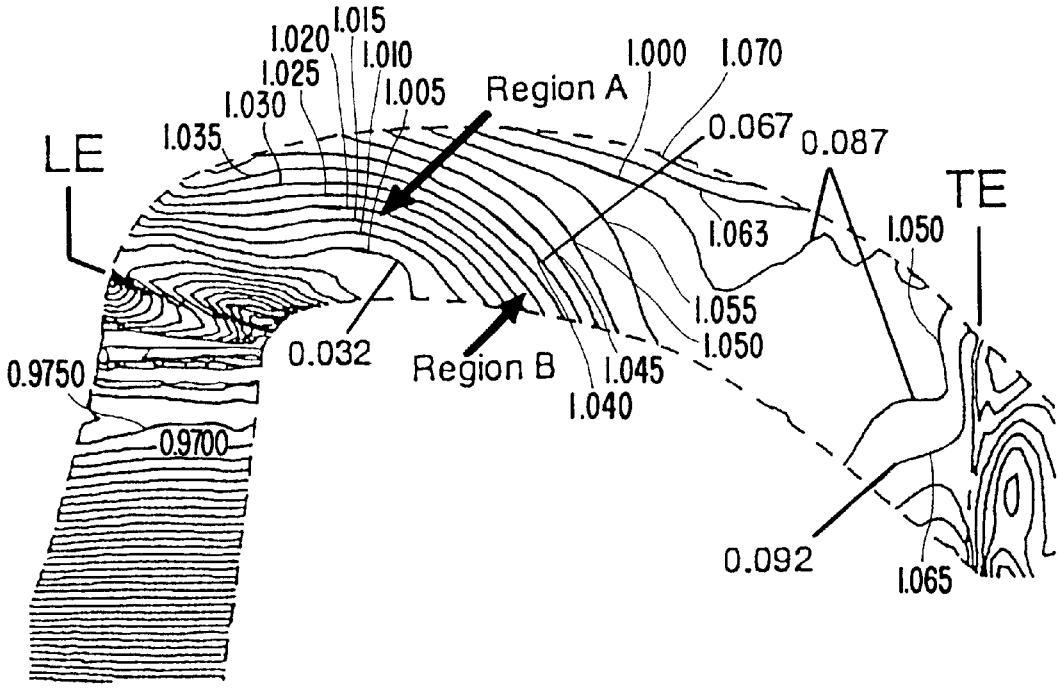
FIG. 6A shows contour lines of pressure distribution in a mixed flow pump of the conventional design.
Figure 6B:
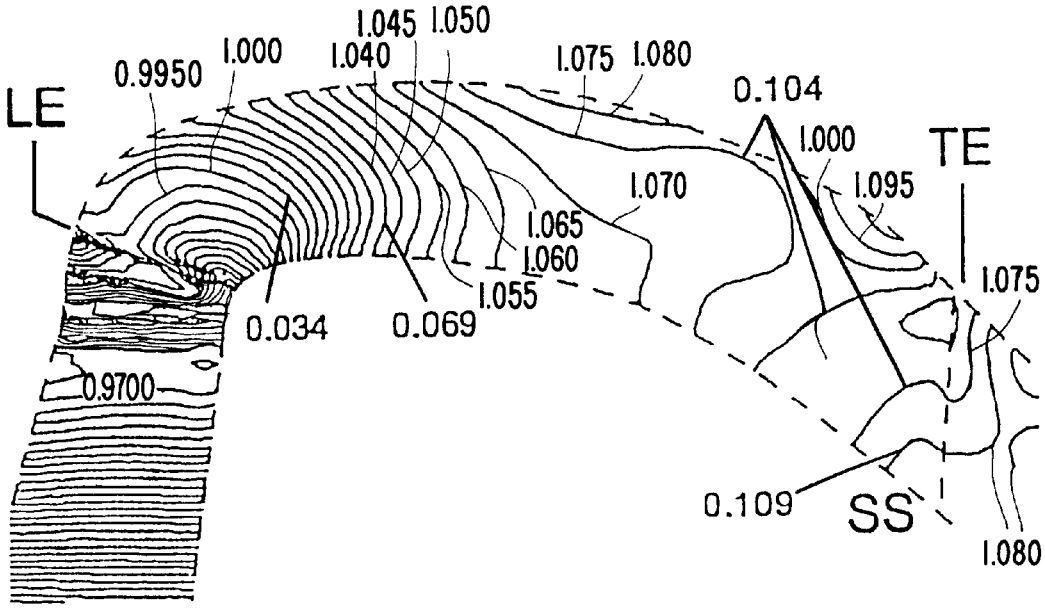
FIG. 6B shows contour lines of the pressure distribution in a mixed flow pump of the present invention.

In the present distribution pattern of the blade angles, the increases in the blade angle $\beta_h$ on the hub surface precedes that on the casing surface. The result is that the pressure increase on the hub-side is completed before the pressure increase is completed on the casing-side. Accordingly, the present diffuser enables the establishment of static pressure contour lines which are nearly perpendicular to the flow passage P as illustrated in a comparative flow pattern shown in FIG. 6B, compared with a conventional flow pattern shown in FIG. 6A. Furthermore, because the pressure increase is completed in the front half of the blade where the boundary layer thickness is small and the resistance to flow separation is high, the present flow fields enable the moderation of the adverse pressure gradient in the region B' where the boundary layer thickness is large and the resistance to flow separation is low, thereby realizing a suppression effect of the flow separation phenomenon.

Figure 7A:
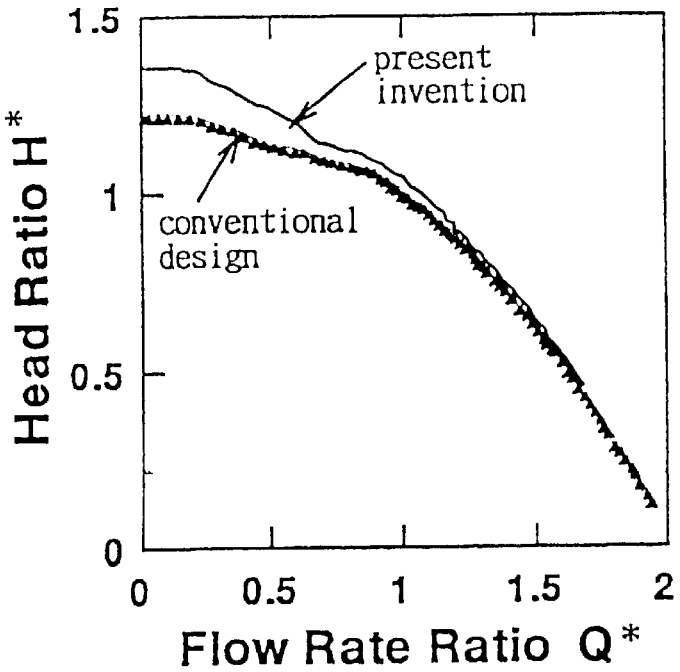
FIGS. 7A and 7B are graphs to show the performance of the mixed flow pump of the present invention in comparison with the conventional one.
Figure 7B:
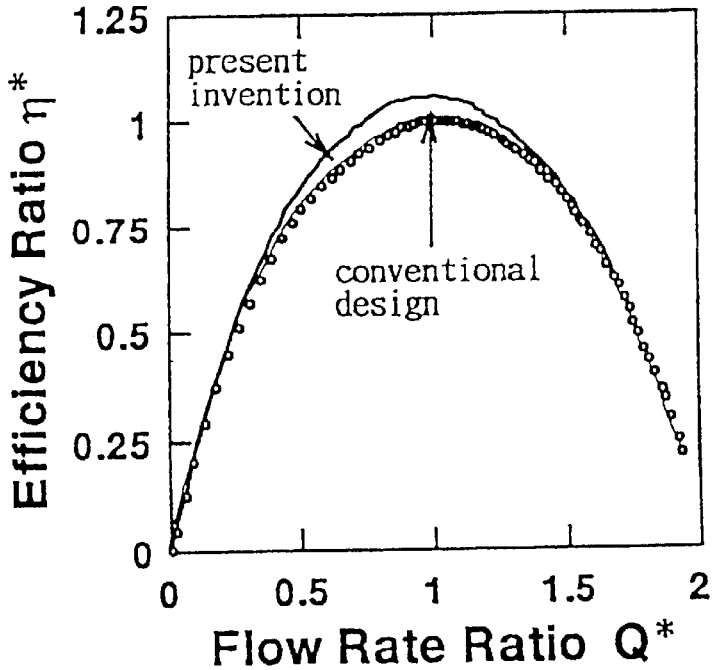
Figure 8A:
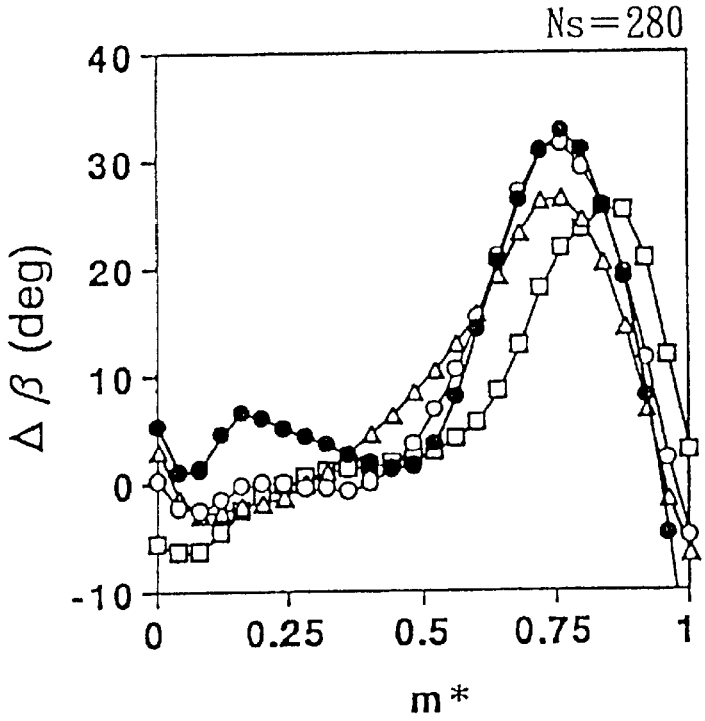
FIGS. 8A~8F are graphs showing the differences in the diffuser blade angles along the flow passage of the present invention from the entry to exit sections at different specific speeds.
Figure 8B:
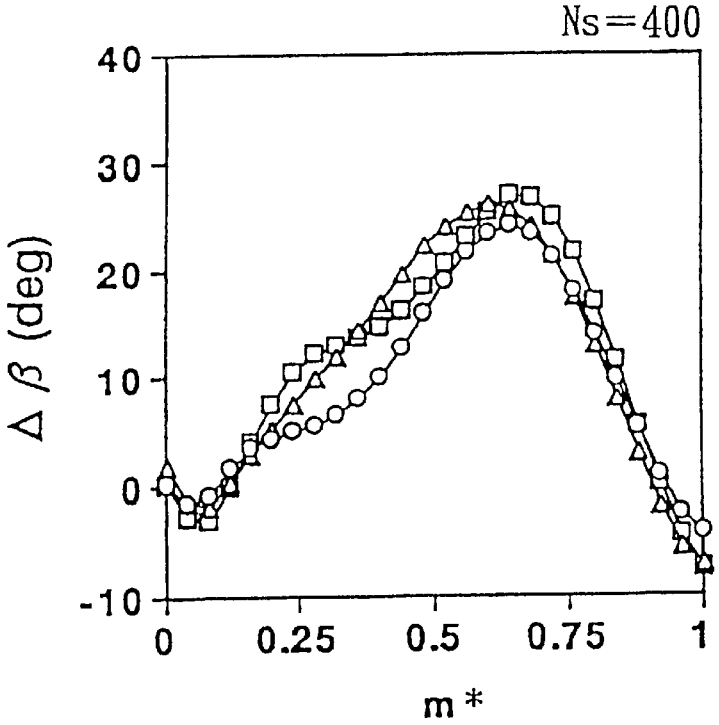
Figure 8C:
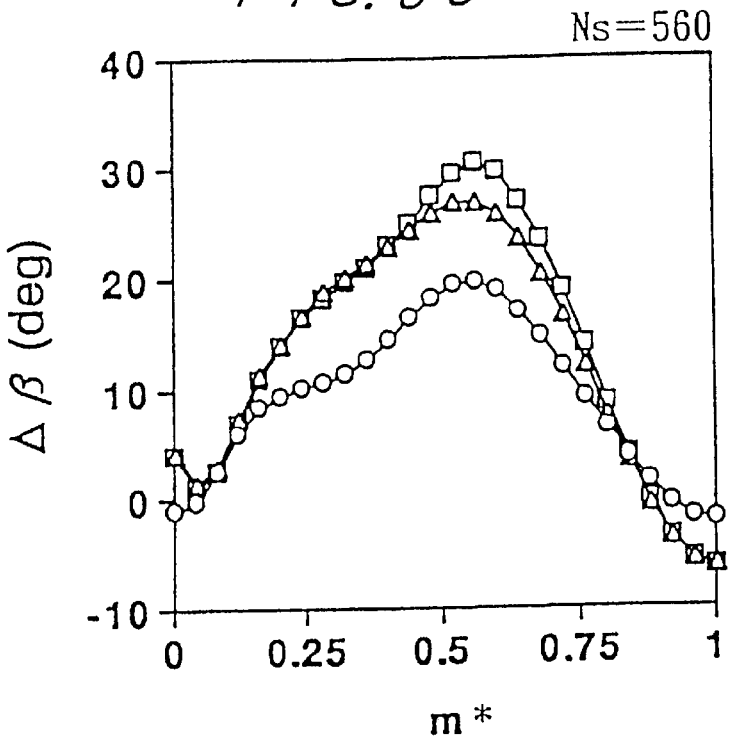
Figure 8D:
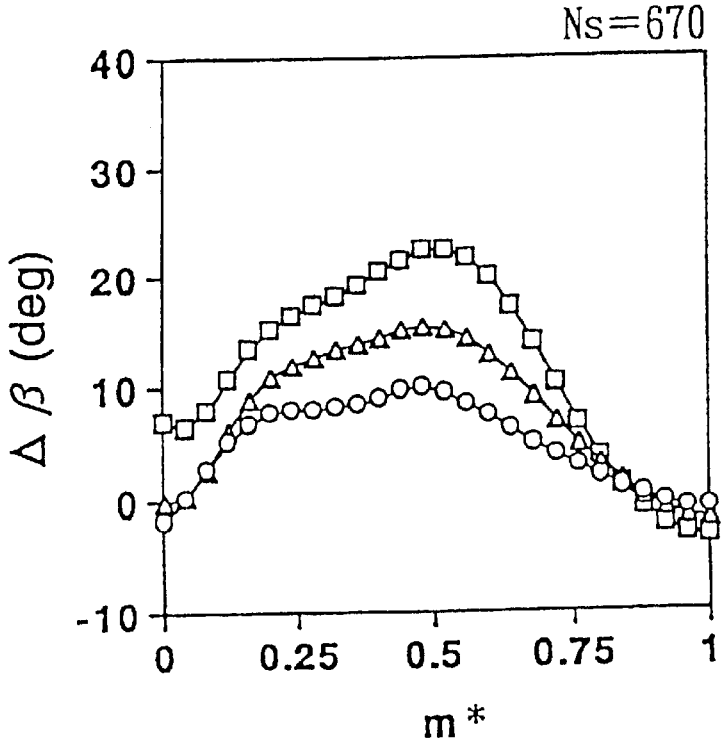
Figure 8E:
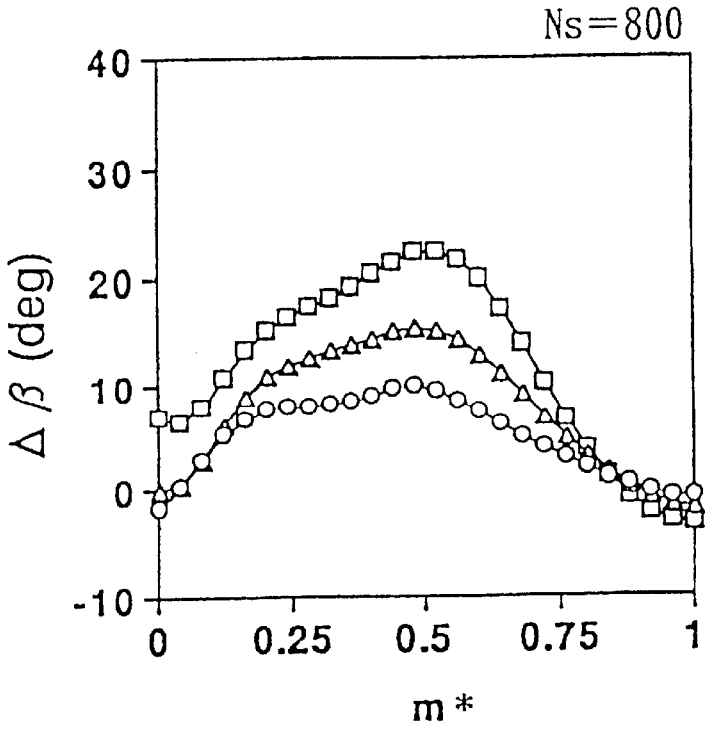
Figure 8F:
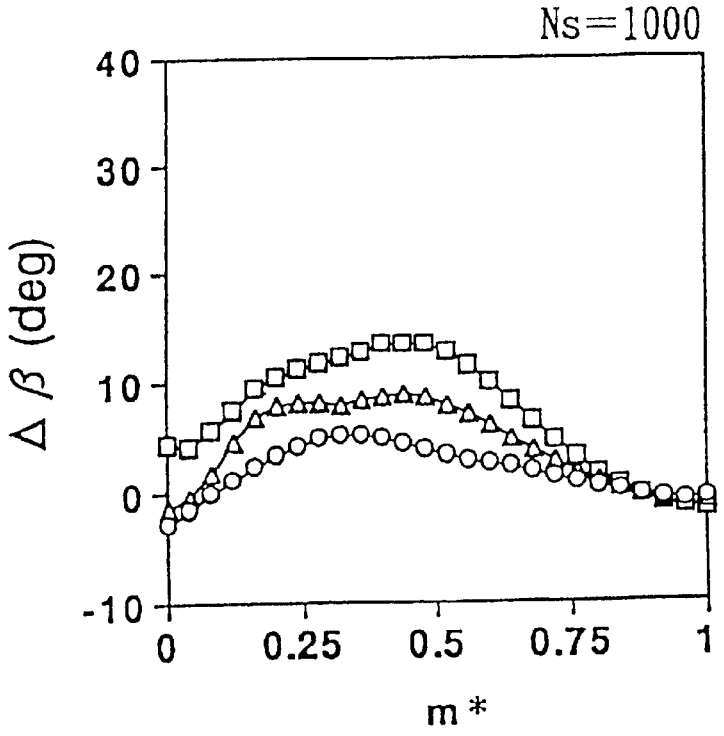

FIGS. 7A and 7B show a performance comparison of a mixed flow pump with the present blade design with an equivalent mixed flow pump with the conventional blade design with a specific speed 280 (m, $m^3$/min, rpm). It can be seen that the present design of the blade angle distribution has produced significant performance improvements over the blade angle distribution used in the conventional design. The specific speed Ns is given by the following equation:

$$N_S=NQ^{0.5}/H^{0.75} \tag{2}$$

where N is a rotational speed of the impeller in rpm, Q is a design flow rate in $m^3$/min and H is the total head of the pump in meters at the design flow rate.

FIGS. 8A~8F show examples of the present design diffuser at specific speeds ranging from 280 to 1,000 (m, $m^3$/min, rpm). Each drawing shows three or four distribution curves of the blade angle difference $\Delta\beta$ of the diffuser blades 20 having different meridional surface shapes. Although differences in the maximum blade angles caused by the differences in the meridional surface shapes can be observed, the characterizing feature of the present diffuser design, that generally the blade angle difference increases sharply along the flow passage, from the entry side to the exit side of the diffuser section, is clearly visible in each example.

It can be seen that the peak point, where the blade angle difference $\Delta\beta$ is a maximum, shifts from the rear half of the flow passage to the front half of the flow passage, as the specific speed increases. It will also be noted that the maximum blade angle difference decreases at higher specific speeds. Also, the rise point, where the blade angle difference begins to increase, is where non-dimensional distance m*=0.4 at a specific speed of 280 while at the specific speeds of over 400, the blade angle difference begins to increase near the leading edge of the diffuser section. As the specific speed decreases, the load on the diffuser blades increases, therefore, in order to prevent the flow separation phenomenon at low specific speeds, it is necessary that a larger blade angle difference $\Delta\beta$ is realized. At all specific speeds, after the blade angle difference reaches a maximum, the difference diminishes quickly towards the trailing edge where non-dimensional distance m* is 1, and at the trailing edge of the diffuser section 14, the difference is almost zero.

Figure 13D:
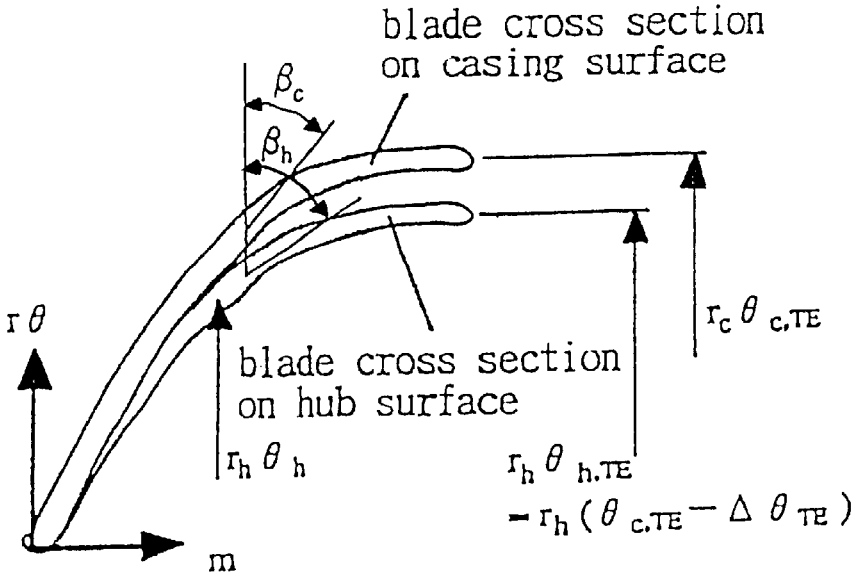
FIG. 13D is a drawing to illustrate the definition of the amended blade angle $\beta^*$ of the diffuser blade when it is slanted.

The circumferential coordinates $\theta_{TE}$ at the trailing edge location of the diffuser section are often made to be identical, from the viewpoint of ease in manufacturing, on the hub ($\theta_{TE}=\theta_{TE,h}$), and on the casing ($\theta_{TE}=\theta_{TE,c}$), so that the trailing edges are oriented in the radial direction. If the blades at the trailing edges are slanted in the circumferential direction (i.e., $\theta_h\neq\theta_c$), performance improvements can be obtained if the distribution of the blade angle difference is amended into an equivalent one satisfying $\theta_h=\theta_c$ condition. Such amendment is conducted according to the following equations:

$$\theta^*_h=\theta_h+m^*\cdot\Delta\beta\theta_{TE} \tag{3}$$

$$\tan\beta^*_h=dm/d(r\theta^*_h) \tag{4}$$

$$\Delta\beta^*=\beta^*_h-\beta_c \tag{5}$$

where $\theta_h$ is a circumferential coordinate of the center line on the hub surface of a blade; $\Delta\theta_{TE}$ is the difference in the circumferential angles at the trailing edge between the hub and the casing ($\theta_{TE,c}-\theta_{TE,h}$); $\theta^*_h$ is circumferential coordinate of the center line of the hub surface after the amendment; $\beta^*_h$ is the blade angle on the hub surface after the amendment; and $\Delta\beta^*$ is the blade angle difference after the amendment (refer to FIG. 13D).

Figure 9A:
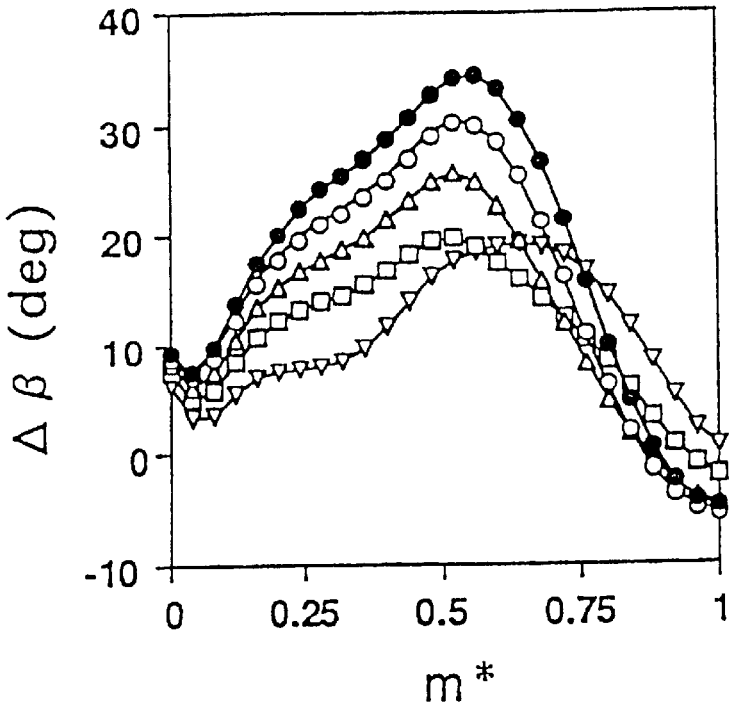
FIG. 9A is a graph showing distribution of blade angle difference $\Delta\beta$ before amendment for the mixed flow pumps of the present invention.
Figure 9B:
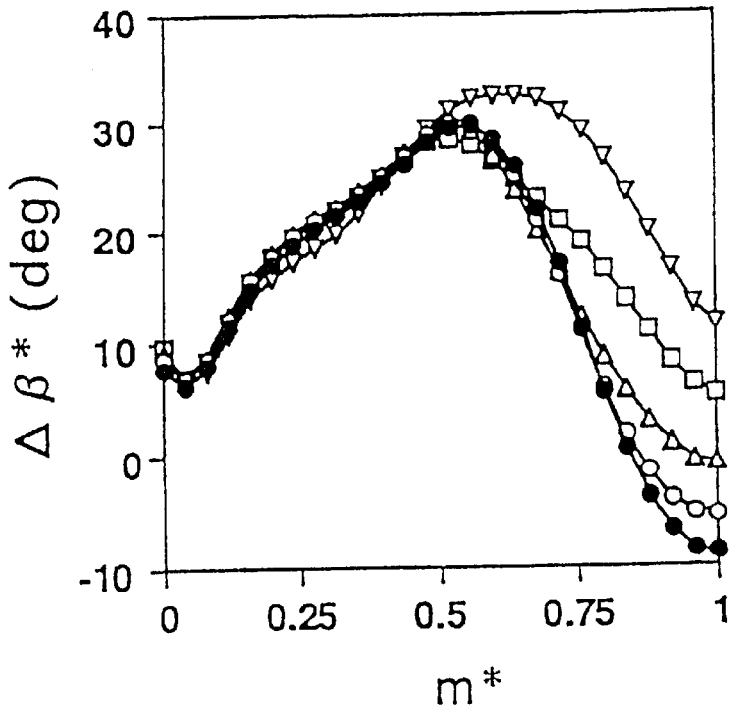
FIG. 9B is a graph showing distribution of blade angle difference $\Delta\beta^*$ after amendment for the mixed flow pumps of the present invention.

FIGS. 9A and 9B show the effects of varying the blade slant angle $\Delta\theta_{TE}$ from about −6 to 17 degrees in an embodiment of a mixed flow pump with a specific speed of 400 (m, $mn^3$/min, rpm). The distribution of the blade angle differenceΔβ before the amendment is different in different blade slant angles $\Delta\theta_{TE}$ as shown in FIG. 9A, but after the amendment process according to the above equations, the distribution of the blade angle difference $\Delta\beta^*$ becomes substantially the same, thereby confirming the fact that the amendment process for $\Delta\beta^*$ is universally applicable. It should be clear from Equation (1), when $\theta_h=\theta_c$, i.e., $\Delta\theta_{TE}=0$, then $\Delta\beta^*=\Delta\beta$.

Figure 10:
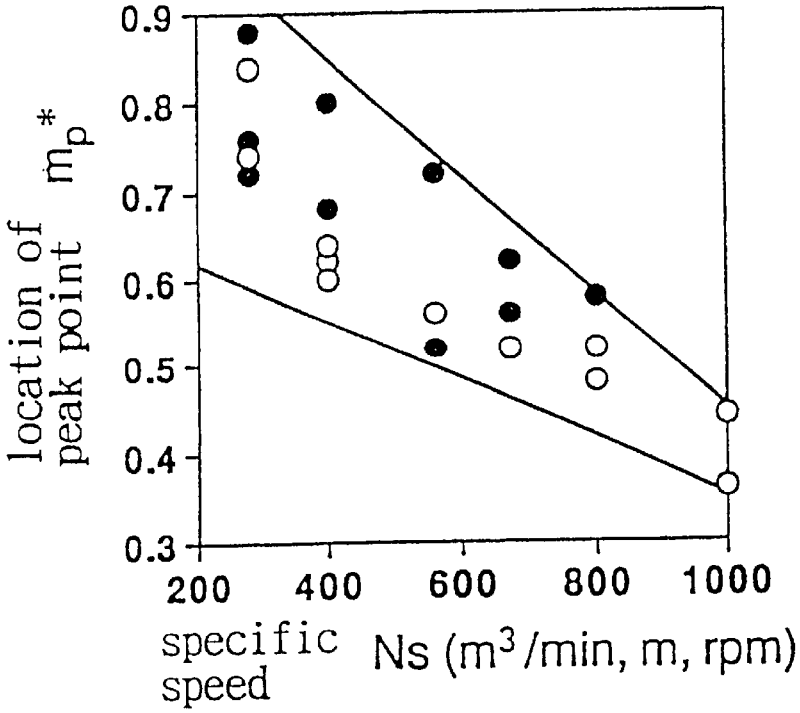
FIG. 10 is a graph showing the relationship between the specific speeds and the non-dimensional distance of the location of the maximum blade angle difference for the mixed flow pumps shown in FIGS. 8A~8F.
Figure 11:
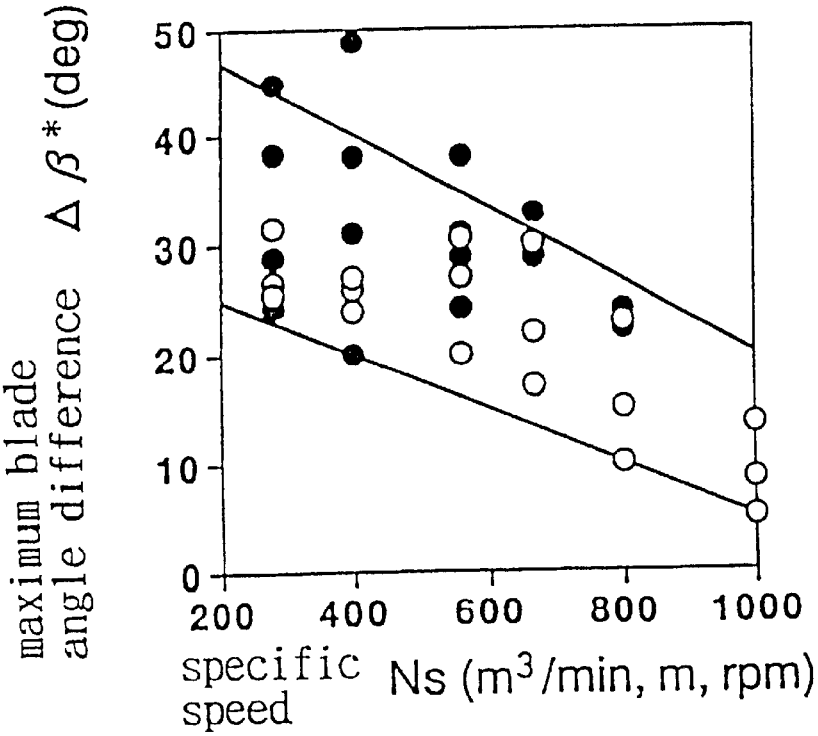
FIG. 11 is a graph showing the maximum blade angle difference as a function of the specific speed for the mixed flow pumps shown in FIGS. 8A~8F.
Figure 12:
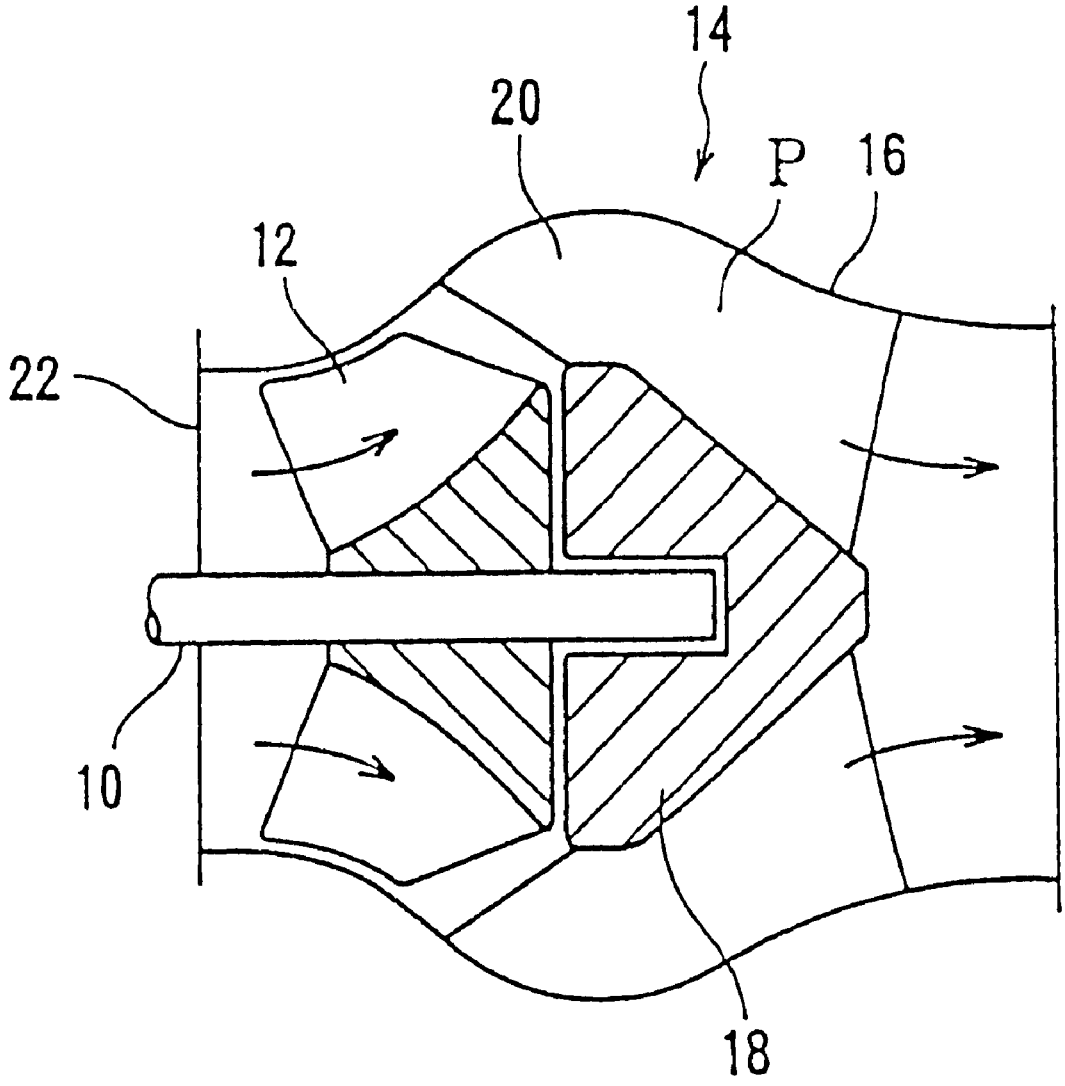
FIG. 12 is a schematic cross sectional view of a conventional mixed flow pump.

FIG. 10 summarizes non-dimensional distance, designated as $m^*_p$, where the blade angle difference $\Delta\beta^*$ shows a maximum value in various examples as a function of the specific speeds, and FIG. 11 summarizes the maximum values of the blade angle difference $\Delta\beta^*$. In the figures, the solid circles ● refer to the cases of slanted blades ($\theta_h \neq \theta$) at the trailing edges of the diffuser section.

As shown by the solid lines in the figures, the lower limit $m^*_{p,min}$ and the upper limit $m^*_{p,max}$ for the non-dimensional distance maximizing the values of the blade angle difference $\Delta\beta^*$; and the lower limit $\Delta\beta^*_{min}$ and the upper limit $\Delta\beta^*_{max}$ for the maximum blade angle difference; are given by the following equations:

$$m^*_{p,min}=0.683-0.0333\cdot(Ns/100) \quad (6)$$

$$m^*_{p,max}=1.12-0.0666\cdot(Ns/100) \quad (7)$$

$$\Delta\beta^*_{min}=30.0-2.50\cdot(Ns/100) \quad (8)$$

$$\Delta\beta^*_{max}=53.3-3.33\cdot(Ns/100) \quad (9)$$

Figure 5B:
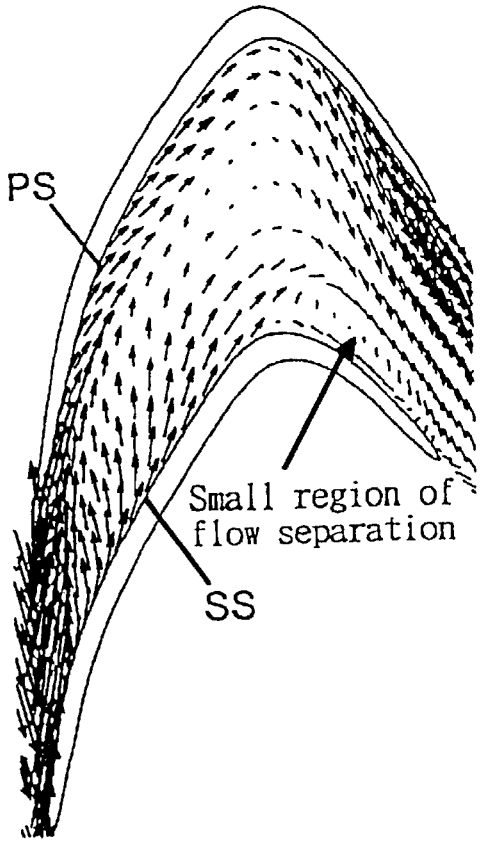
Figure 14A:
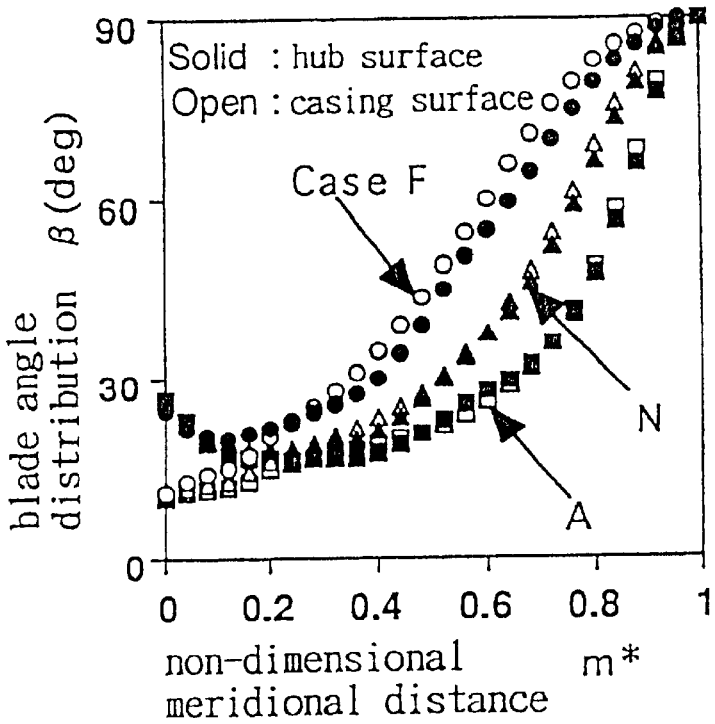
FIG. 14A is a graph showing a distribution pattern of blade angles in the diffuser section of a conventional mixed flow pump.
Figure 14B:
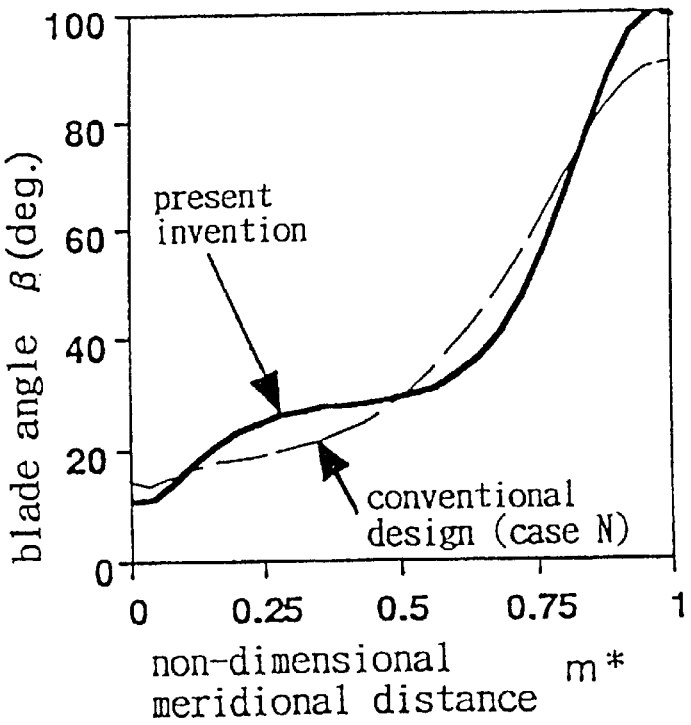
FIG. 14B is a graph showing a distribution pattern of average blade angles in the diffuser section of the mixed flow pump of the present invention compared with a conventional one.
Figure 19A:
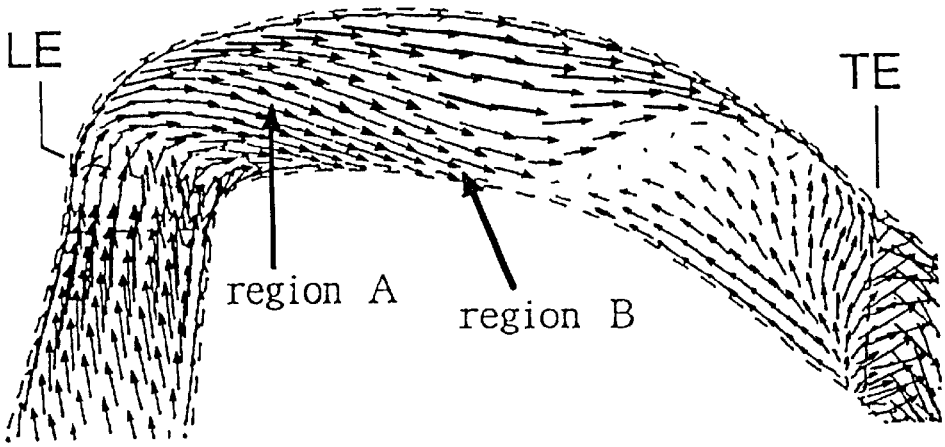
FIGS. 19A and 19B show velocity vector patterns in the diffuser section of the conventional mixed flow pump.
Figure 19B:
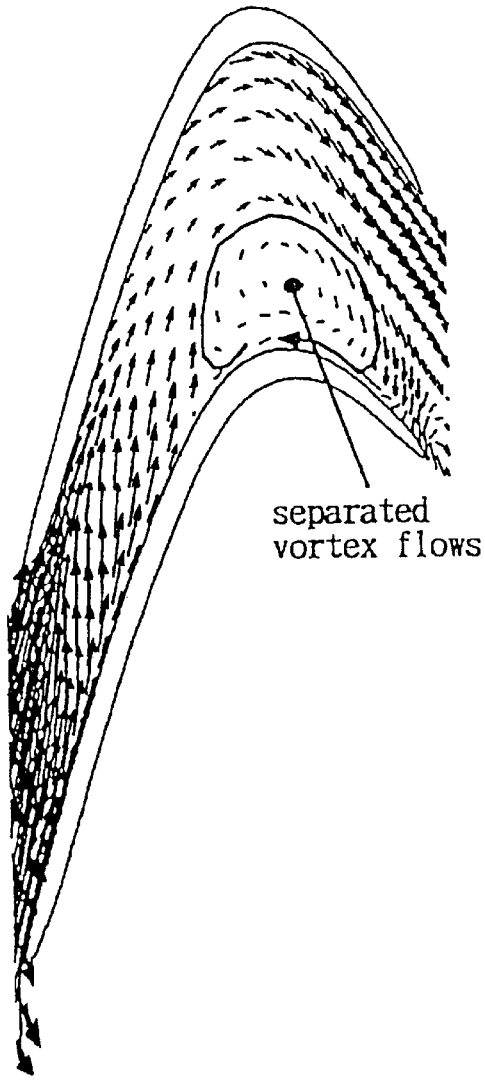

FIG. 14B shows an example of a pump with a specific speed of 280 (m, $m^3$/min, rpm), and compares the distribution patterns of the average blade angles at mid-span location in the present diffuser section (refer to FIG. 2) and those in the conventional diffuser section (refer to FIG. 14A, case N). Clearly demonstrated, although the two cases share roughly similar distribution patterns of the average blade angles, the conventional pump shows a large degree of flow separation as shown in FIGS. 19A and 19B, whereas the present pump shows suppression of flow separation as shown in FIGS. 5A and 5B, and the pump performance is significantly improved as shown in FIGS. 7A and 7B. These results demonstrate convincingly that what is important is not the average blade angle distribution pattern but it is the difference in the blade angle on the hub and casing that determines the pump performance. It can be understood that a major cause of degradation in the pump performance is that the conventional diffusers have placed emphasis on a smooth transition of the blade angle distribution pattern from the entry to the exit, and no special consideration has been given to the important role of the changes in the blade angle difference distribution pattern between the hub surface and the casing surface of the blades from the entry to the exit of the diffuser section, as in the present invention.

In brief summary, the present invention has demonstrated that an efficient mixed flow pump can be produced by designing the diffuser blade so that the difference in the blade angle, at the hub and at the casing, changes according to a specific distribution pattern, along the flow passage from the entry-side to the exit-side in the diffuser section. The distribution pattern is determined by the criteria to optimize the generation of secondary flows and to prevent separation at the corners of the flow passage cross section in the diffuser section.

What is claimed is:

1. A mixed flow pump comprising a casing having an axis and defining an impeller section and a diffuser section disposed downstream of said impeller section, said impeller section comprising an impeller adapted to rotate about the axis, said diffuser section having a hub and a plurality of stationary diffuser blades, wherein said diffuser blades are formed so that an angular difference between a hub blade angle and a casing blade angle conforms to a specific distribution pattern along a flow passage of said diffuser section, the specific distribution pattern being such that the angular difference increases along the flow passage, reaches a maximum difference, and then decreases along the flow passage.

2. A mixed flow pump according to claim 1, wherein the hub blade angle and the casing blade angle are each defined in terms of an angle between a circumferential tangent line at a point on a surface of one of said diffuser blades at a level of a hub surface or a casing surface, respectively, and a tangent line of a center line of a cross section of one of said diffuser blades along said hub surface or said casing surface, respectively, and the specific distribution pattern is such that an increase in the hub blade angle on said hub surface precedes that of the casing blade angle on said casing surface along the flow passage.

3. A mixed flow pump according to claim 2, wherein a lower limit of a maximum value in a distribution pattern of amended blade angle differences ($\Delta\beta^*$), defined by a difference ($\beta^*_h-\beta_c$) between the hub blade angle amended to be an amended hub blade angle ($\beta^*_h$) on a hub end of one of said diffuser blades and the casing blade angle ($\beta_c$) on a casing end of one of said diffuser blades, is located on an exit-side of a location with a non-dimensional distance $m^*_{p,min}$ represented by an equation: $m^*_{p,min}=0.683-0.0333\cdot(Ns/100)$.

4. A mixed flow pump according to claim 3, wherein an upper limit of the maximum value in the distribution pattern of the amended blade angle differences ($\Delta\beta^*$) is located on an entry-side of a location with a non-dimensional distance $m^*_{p,max}$ represented by an equation: $m^*_{p,max}=1.12-0.0666\cdot(Ns/100)$.

5. A mixed flow pump according to claim 2, wherein a lower limit of a maximum value in a distribution pattern of amended blade angle differences ($\Delta\beta^*$), defined by a difference ($\beta^*_h-\beta_c$) between the hub blade angle amended to be an amended hub blade angle ($\beta^*_h$) on a hub end of one of said diffuser blades and the casing blade angle ($\beta_c$) on a casing end of one of said diffuser blades, is not less than a value given by an equation: $\Delta\beta^*_{min}=30.0-2.50\cdot(Ns/100)$.

6. A mixed flow pump according to claim 5, wherein an upper limit of the maximum value in the distribution pattern of the amended blade angle differences $\Delta\beta^*$ is not more than a value given by an equation: $\Delta\beta^*_{max}=53.3-3.33\cdot(Ns/100)$.

7. A mixed flow pump according to claim 1, wherein a lower limit of a maximum value in a distribution pattern of amended blade angle differences ($\Delta\beta^*$), defined by a difference ($\beta^*_h-\beta_c$) between the hub blade angle amended to be an amended hub blade angle ($\beta^*_h$) on a hub end of one of said diffuser blades and the casing blade angle ($\beta_c$on a casing end of one of said diffuser blades, is located on an exit-side of a location with a non-dimensional distance $m^*_{p,min}$ represented by an equation: $m^*_{p,min}=0.683-0.0333\cdot(Ns/100)$.

8. A mixed flow pump according to claim 7, wherein an upper limit of the maximum value in the distribution pattern of the amended blade angle differences ($\Delta\beta^*$) is located on an entry-side of a location with a non-dimensional distance $m^*_{p,max}$ represented by an equation: $m^*_{p,max}=1.12-0.0666\cdot(Ns/100)$.

9. A mixed flow pump according to claim 1, wherein a lower limit of a maximum value in a distribution pattern of amended blade angle differences ($\Delta\beta^*$), defined by a difference ($\beta^*_h-\beta_c$) between the hub blade angle amended to be an amended hub blade angle ($\beta^*_h$) on a hub end of one of said diffuser blades and the casing blade angle ($\beta_c$) on a casing end of one of said diffuser blades, is not less than a value given by an equation: $\Delta\beta^*_{min}=30.0-2.50\cdot(Ns/100)$.

10. A mixed flow pump according to claim 9, wherein an upper limit of the maximum value in the distribution pattern of the amended blade angle differences $\Delta\beta^*$ is not more than a value given by an equation: $\Delta\beta^*_{max}=53.3-3.33\cdot(Ns/100)$.

* * * * *